US005924807A

United States Patent [19]

Ambrose et al.

[11] Patent Number: 5,924,807

[45] Date of Patent: Jul. 20, 1999

[54] SECURABLE DEVICE FOR COMPUTER APPARATUS

[75] Inventors: Frederic C. Ambrose, Brewster; David Hawley, Sterling, both of Mass.

[73] Assignee: Flex-Rest, LLC, Brewster, Mass.

[21] Appl. No.: 08/812,671

[22] Filed: Mar. 10, 1997

Related U.S. Application Data

[63] Continuation-in-part of application No. 08/315,098, Sep. 29, 1994, and application No. 08/632,640, Apr. 15, 1996, Pat. No. 5,667,320.

[51] Int. Cl.[6] ..... B41J 5/08

[52] U.S. Cl. ..... 400/472; 400/676

[58] Field of Search ..... 400/472, 473, 400/480, 481, 489, 488, 681, 715, 667, 676, 677, 678, 663; 235/146, 145 R, 145 A; 248/918, 118, 118.1, 118.2, 118.3, 118.5, 551, 552, 553; 312/333, 23.3, 219

[56] References Cited

U.S. PATENT DOCUMENTS

| | | | |
|---|---|---|---|
| 293,971 | 2/1884 | Lyford | 38/107 |
| 1,189,529 | 7/1916 | Benson | 38/106 |
| 1,293,057 | 2/1919 | Dunlop | 400/678 |
| 1,488,330 | 3/1924 | Eeritt | 312/333 |
| 1,574,712 | 2/1926 | Stone | 312/219 |
| 3,592,521 | 7/1971 | Cox | 312/333 |
| 3,649,095 | 3/1972 | Gunzburg | 312/333 |
| 3,788,678 | 1/1974 | Switzgable | 292/7 |
| 4,307,672 | 12/1981 | Shikimi | 108/139 |
| 4,600,249 | 7/1986 | Anderson | 312/196 |
| 4,606,566 | 8/1986 | Bott | 292/57 |
| 4,624,510 | 11/1986 | Jedziniak | 248/918 |
| 4,644,875 | 2/1987 | Watt | 108/143 |
| 4,688,862 | 8/1987 | Fowler et al. | 248/118.3 |
| 4,709,972 | 12/1987 | LaBudde et al. | 312/208 |
| 4,736,689 | 4/1988 | Stanko | 108/5 |
| 5,016,367 | 5/1991 | Breen et al. | 38/107 |
| 5,205,631 | 4/1993 | Wegman et al. | 312/348.3 |
| 5,273,250 | 12/1993 | Pemberton et al. | 248/918 |
| 5,351,897 | 10/1994 | Martin | 248/918 |
| 5,357,873 | 10/1994 | Hilton | 108/92 |
| 5,437,235 | 8/1995 | Randolph | 108/25 |
| 5,590,607 | 1/1997 | Howard | 108/98 |

FOREIGN PATENT DOCUMENTS

| | | | |
|---|---|---|---|
| 2117169 | 9/1995 | Canada . | |
| 959 | 10/1911 | United Kingdom | 400/676 |

OTHER PUBLICATIONS

"Swivel Mouse Platform", Quill Catalog May–Oct., 1996, p. 405.

"Pivot Mouse Pad", Ergo–Shop Catalog, p. 20, Feb. 1996.

*Primary Examiner*—Edgar Burr
*Assistant Examiner*—Anthony H. Nguyen
*Attorney, Agent, or Firm*—Testa, Hurwitz & Thibeault, LLP

[57] ABSTRACT

Disclosed is a device adapted to mount to a desk for use with a computer keyboard, a mouse, or a system such as a laptop computer. In one embodiment, the device includes a stationary bracket attachable to the desk, a main housing in sliding engagement with the stationary bracket, and a keyboard support tray connected to the main housing and adapted to support the keyboard or laptop computer. The device further includes a palm rest and an optional mouse support tray. The elevation of the keyboard support tray, palm rest, and mouse support tray may be independently adjusted. The keyboard and mouse support trays may also be independently tilted to achieve a comfortable working configuration. A locking member may also be provided to secure the housing and keyboard support tray in a stored position under the desk to prevent theft or computer system operation by unauthorized persons. An anti-pry feature may also be provided for additional security.

14 Claims, 15 Drawing Sheets

10
12
14
178
182
24
20
148
152
16
18
150
146
22

12
64
66
68
70
72
74
76
78
80
82
83
84
85
86
19
11

SECURABLE DEVICE FOR COMPUTER APPARATUS

This application is a continuation-in-part of application Ser. Nos. 08/315,098 filed on Sep. 29, 1994, and 08/632,640 filed on Apr. 15, 1996, now U.S. Pat. No. 5,667,320.

FIELD OF THE INVENTION

The present invention relates generally to devices used in the connection with office equipment. More particularly, the present invention relates to a device for use with a computer system having a keyboard and/or a mouse.

BACKGROUND OF THE INVENTION

With the advent of computer systems, people both at home and at the work-place spend numerous hours sitting at the computer system and typing keys on the computer keyboard and/or moving a mouse. Medical professionals, ergonomists and insurance companies agree that significant medical problems result from the prolonged use of computer systems in the workplace.

One of the inventors of the present invention is also the inventor of U.S. Pat. No. 5,405,204 entitled "Keyboard Positioning System", the disclosure of which is herein incorporated by reference. The device disclosed and claimed in that patent solves many of the aforementioned problems resulting from the prolonged use of computer systems. The device of that patent generally includes an adjustable keyboard tray in combination with an adjustable palm rest. The device is operable so that a user can independently adjust the position of the keyboard to a desired negative tilt position as well as independently adjust the palm rest to the position most comfortable to the user. The present invention represents furthers improvements to the device disclosed in that patent and keyboard support tray devices in general.

SUMMARY OF THE INVENTION

One object of the present invention is to develop a device for use with a computer system having a keyboard which allows the user to adjust easily the position of the keyboard and the palm rest.

Another object of the present invention is to develop a device for use with a computer system having a keyboard and a mouse which allows the user to adjust the position of the mouse independently of either the keyboard and/or the palm rest.

Still another object of the present invention is to develop a device for use with a computer system having an input device which allows the user to secure at least the input device, and in certain cases the entire computer system, against unauthorized use or access.

The above objects of the present invention have been realized with the device of the present invention which is adapted to mount to a desk, table, or other type of work surface or station and for use with a computer system having a keyboard and/or a mouse. In one embodiment, the device of the present invention generally includes a stationary bracket that is attached to and disposed below the desk. The device further includes a main housing which is movably attached to the stationary bracket such that the user may easily slide the main housing from a "stored position" inward of the stationary bracket to a "operable position" outward of the stationary bracket. The device further includes an adjustable keyboard support tray which is adapted to receive a keyboard. The device further includes an adjustable palm rest. The device further includes at least one engagement member operable from an "engaged position" to a "disengage position". When the engagement member is in the disengaged position, both the keyboard and palm rest may be adjusted to the position best suited for the user of the computer system. When the engagement member is in the engaged position, both the keyboard support tray and the palm rest are fixed.

In another embodiment, the present invention may further include a mouse support tray adapted for use with a mouse. The mouse support tray may be adjusted independently of both the keyboard support tray and the palm rest. The mouse support tray may be adjusted in both the vertical and tilted position as well being rotatable in the horizontal position. Moreover, the mouse support tray may be moved from an inboard "stored portion" to an outboard "operable position."

In a further embodiment, the present invention may include a locking member for securing the housing in the stored position to prevent unauthorized use of or access to the keyboard, mouse, or other computer apparatus located on the keyboard support tray or mouse support tray. The locking member may be located in the palm rest which is pivoted between an open position for use and a closed position for securing the computer apparatus.

With the device of the present invention, a user can easily adjust and lock the position of the keyboard support tray and the palm rest with a single engagement member. As such, the device of the present invention allows the user to quickly setup for a comfortable work session on the computer system thereby proving more efficient use of time and reducing injuries that result from such use. Further, the device can be secured readily as a safety measure to prevent computer system operation by unauthorized persons and as a security measure to prevent theft of computer apparatus supported therein. As used herein, the term computer apparatus includes input devices such as keyboards and mice, output devices such as printers and displays, storage devices such as disk drives and tape drives, and computer systems such as laptops computers and other portable computers.

BRIEF DESCRIPTION OF THE DRAWINGS

The following detailed description of the present invention will be more fully understood with reference to the accompanying drawings in which.

DETAILED DESCRIPTION OF THE INVENTION

Figure 1:
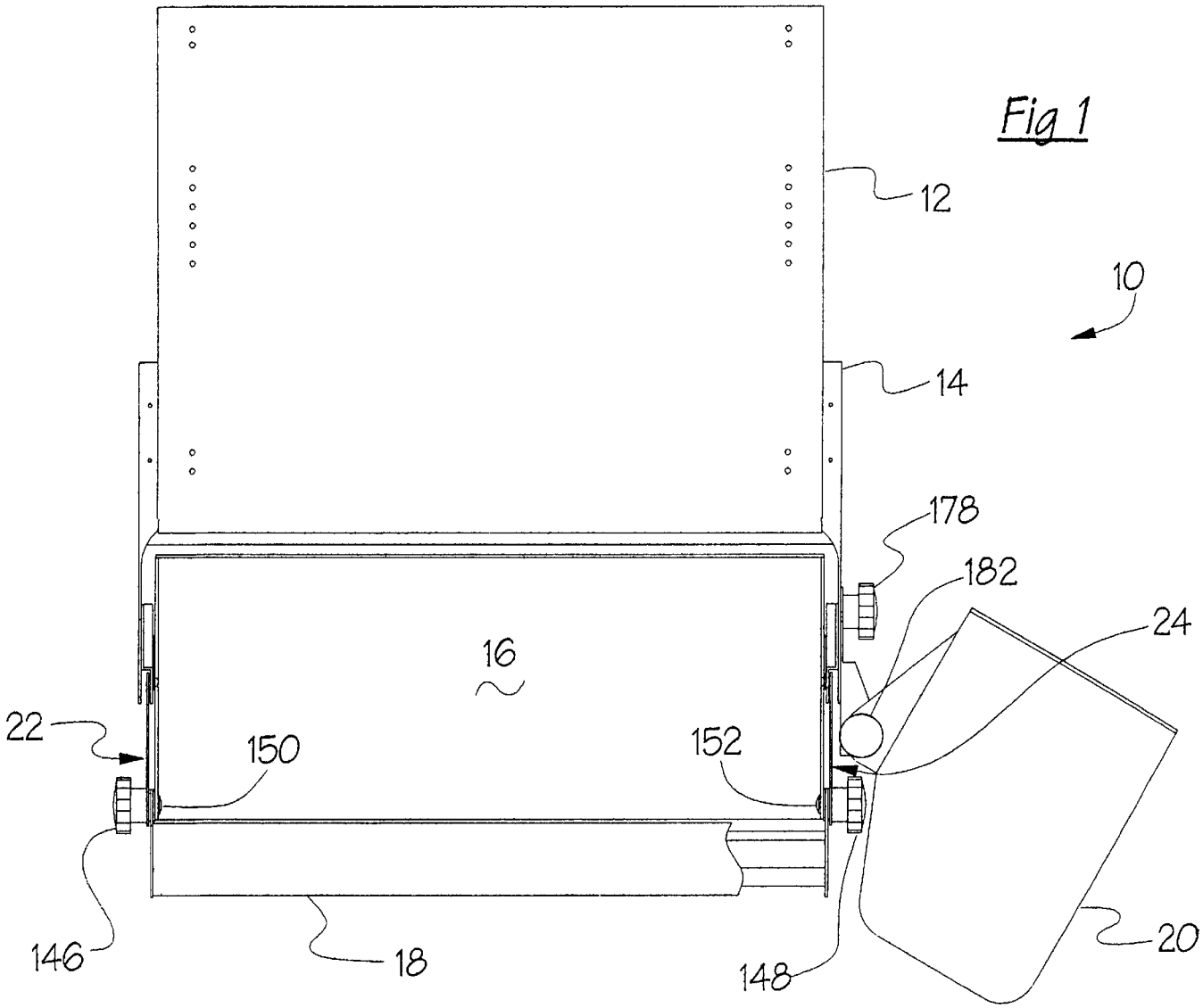
FIG. 1 is a top view of the device of the present invention which shows among things the mouse support tray in an operable position.
Figure 2:
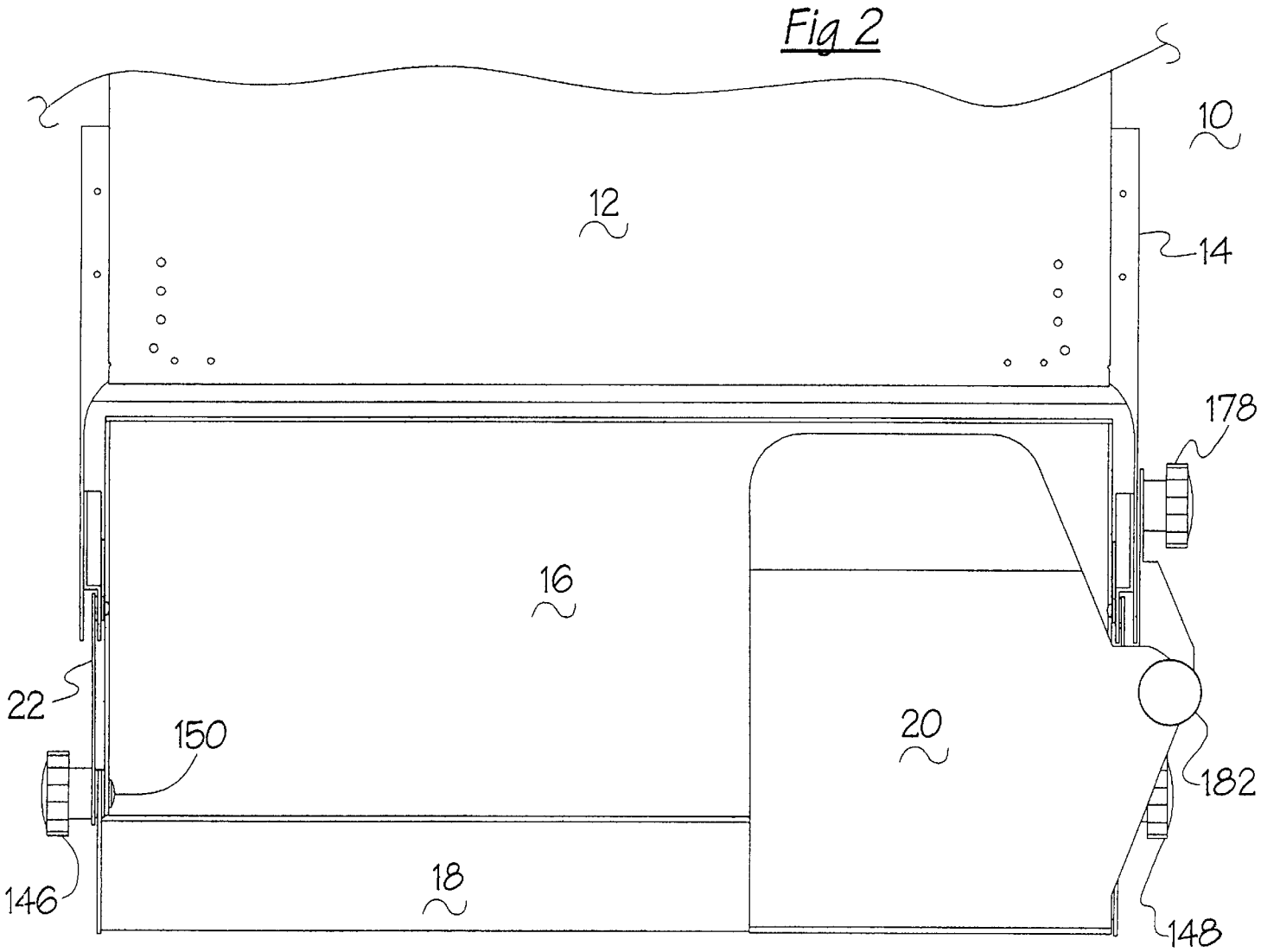
FIG. 2 is a top view of the device of the present invention which shows among things the mouse support tray in a stored position.
Figure 3:
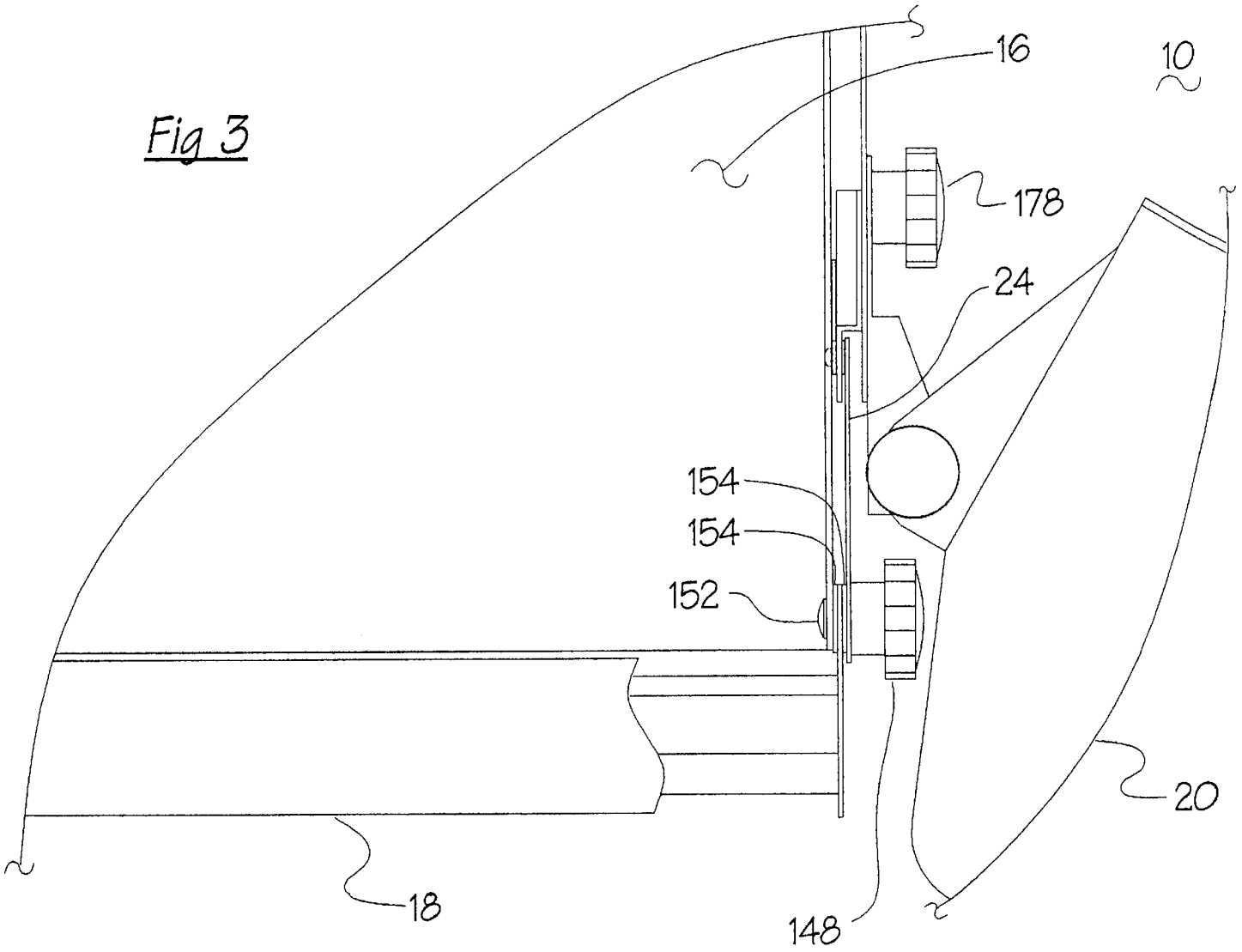
FIG. 3 is a cutaway top view of the device of the present invention.
Figures 4, 5, 6, 7:
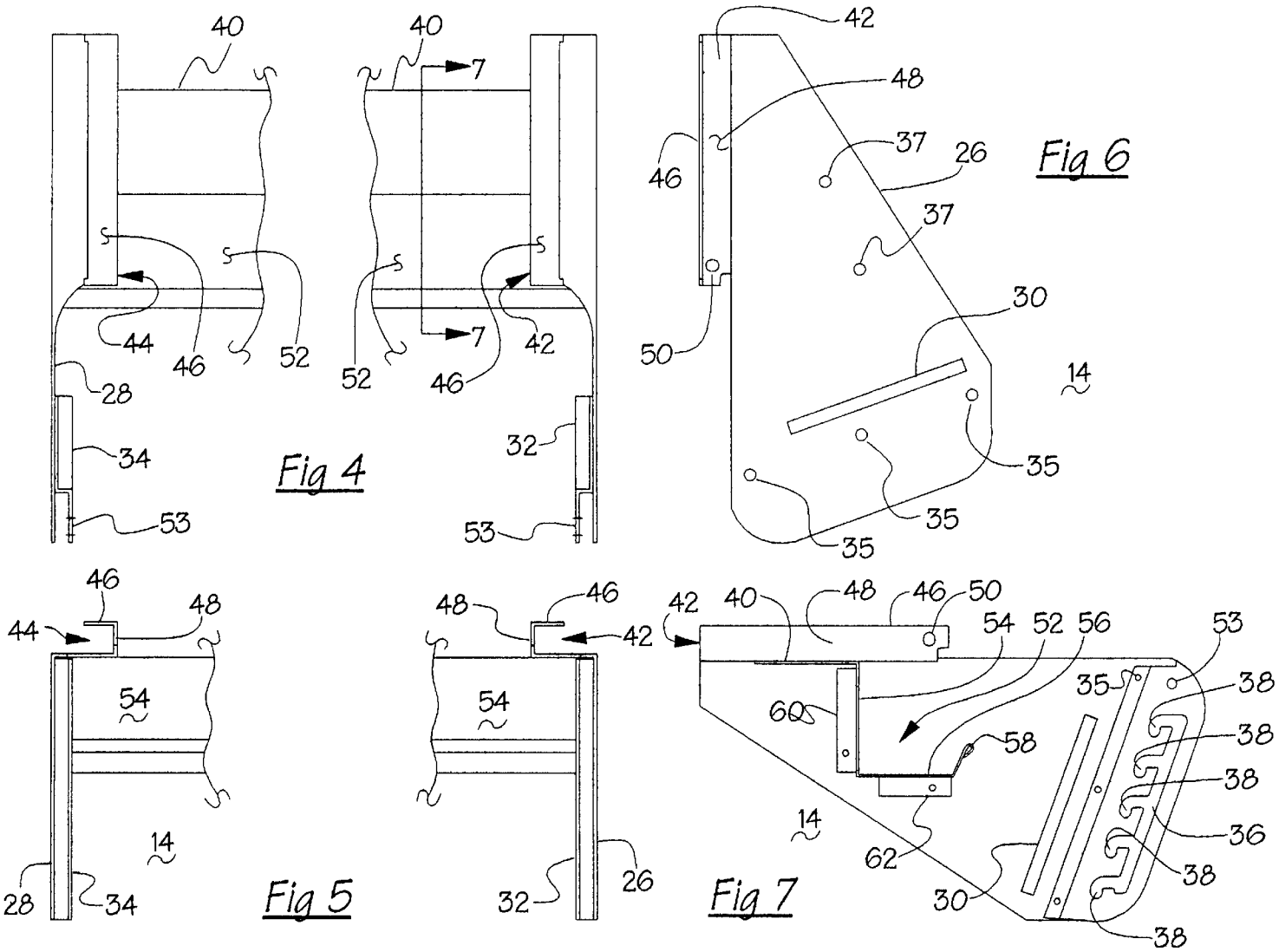
FIG. 4 is a top view of the main housing.
FIG. 5 is a front view of the main housing.
FIG. 6 is a side view of the main housing.
FIG. 7 is a cross-sectional view of the main housing taken along line 7—7 of FIG. 4.
Figures 8, 9, 10, 11:
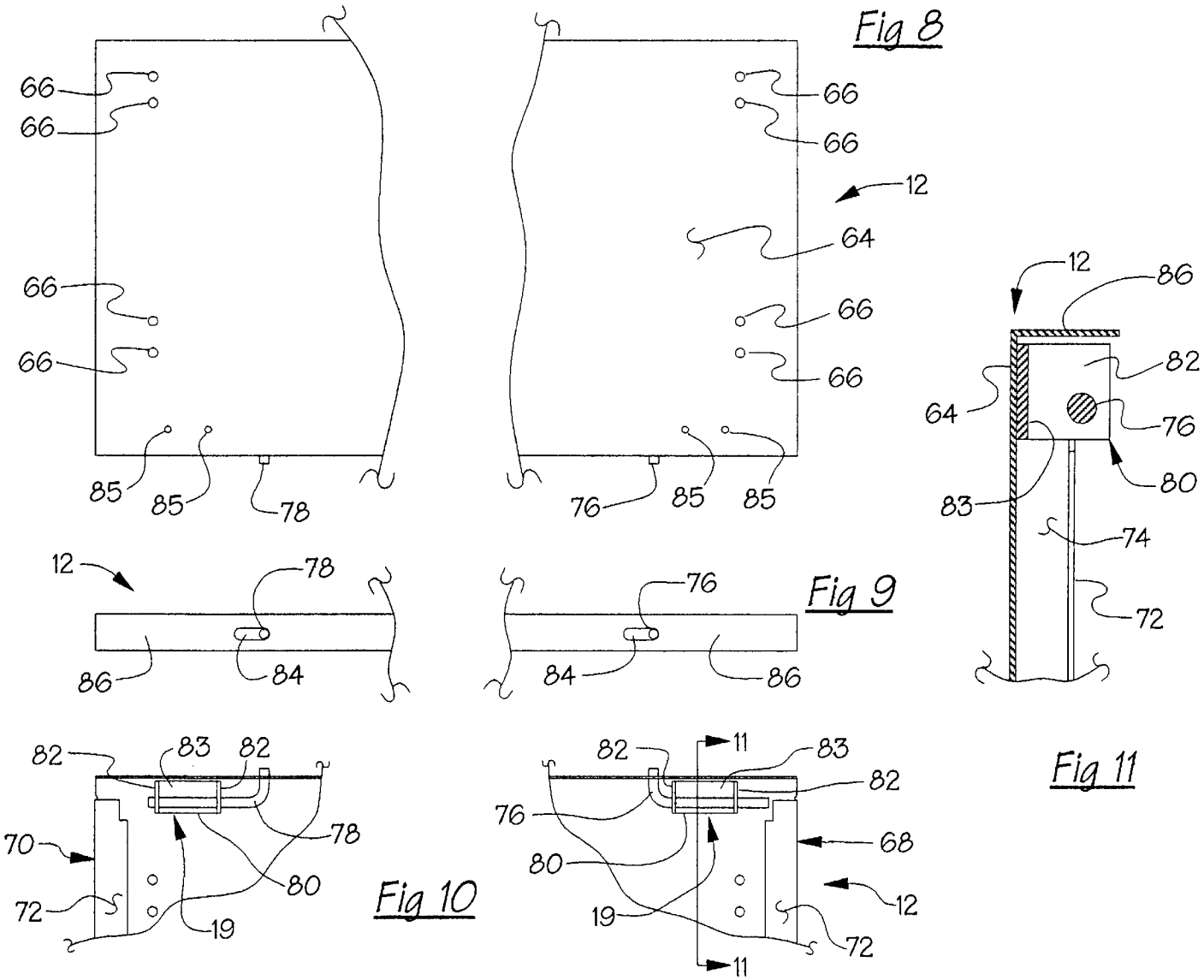
FIG. 8 is a top view of the stationary bracket.
FIG. 9 is a front view of the stationary bracket.
FIG. 10 is a bottom view of the stationary bracket.
FIG. 11 is a cross-sectional view of the stationary bracket taken along line 11—11 of FIG. 10.

Referring to FIGS. 1–3, one embodiment of the device 10 of the present invention generally includes a stationary bracket 12, a main housing 14, a keyboard support tray 16, a palm rest 18, a mouse support tray 20, and engagement members 22 and 24. The stationary bracket 12 is generally designed to securely attach to and be disposed below a desk top, table, or any other work surface (not shown). The main housing 14 is generally provided as a support structure to supportably mount the keyboard support tray 16 and the mouse support tray 20. The main housing 14 and the stationary bracket 12 are mutually designed such that a user may slide the main housing 14 from a "stored position" (not shown) where the main housing 14 is disposed substantially below the stationary bracket 12 and thus the desk (not shown) to an "operable position" as shown in the drawings where the keyboard support tray 16 and mouse support tray 20 may be used to support a keyboard (not shown) and/or a mouse (not shown), respectively. The keyboard support tray 16 is generally adapted to receive a keyboard (not shown) and may be adjusted both in the vertical as well as tilt position. In the preferred embodiment, the keyboard support tray be adjusted from a substantially horizontal position to a negative tilt position of approximately twenty-five (25) degrees or more. The palm rest 18 is generally adapted to provide a support surface for the user's palms and/or wrists and may be adjusted to any one of a variety of positions best suited for the user of the device 10. Engagement members 22 and 24 are provided so that a user may operate a single mechanism to adjust and then lock the position of the keyboard support tray 16 and palm rest 18. The engagement members 22 and 24 are operable from a "disengaged position" to an "engaged position" whereby in the disengaged position, both the keyboard support tray 16 and the palm rest 18 may be adjusted to a most comfortable position for the user of the computer system. Conversely, in the engaged position both the keyboard support tray 16 and the palm rest 18 are fixed and ready for use. The mouse support tray 20 is generally designed to receive a mouse (not shown). The mouse support tray 20 is adjustable to any one of a variety of positions comfortable for the user and independently of both the keyboard support tray 16 and the palm rest 18. In the preferred embodiment, the mouse support tray 20 may be adjusted in the vertical plane as well as tilted relative to the vertical plane. Moreover, the mouse support tray 20 may be adjustably positioned in the horizontal plane, for example, from an outboard position to an inboard position.

Referring to FIGS. 4–7, the main housing 14 is shown generally comprising side walls or panels 26 and 28 each having a slot 30 for use when the mouse support tray 20 is employed. The side walls 26 and 28 have bracket members 32 and 34, respectively, attached to a front portion of the side walls by conventional means such as rivets 35. Each of the bracket members 32 and 34 includes a slot 36 and a plurality of openings 38 which function to provide a variety of vertical and pivot support positions for the keyboard support tray 16. Each of the bracket members 32 and 34 further includes an opening 53 which, as will be described more fully herein, is provided to rotatably mount the engagement members 24 and 22, respectively. Although in the preferred embodiment, the brackets 32 and 34 are attached to the side walls 26 and 28, respectively, the side walls 26 and 28 may be integrally formed with the slot 36 and openings 38. The main housing 14 further includes a support member 40 having flanges 42 and 44 disposed on the upper and opposite sides thereof. Flanges 42 and 44 are adapted to slidably engage with the stationary bracket 12. Each of the flanges 42 and 44 has an upper and horizontally disposed surface or wall 46 perpendicular to a vertically disposed wall or surface 48. Each of the flanges 42 and 44 further includes an opening 50 disposed within the vertically disposed walls 48. As will be described more fully herein, the openings 50 function with a locking mechanism 19 (to be described) so that when the locking mechanism 19 is engaged, the main housing 14 cannot slide inward and/or outward of the stationary bracket 12 from the operable position. The support member 40 further includes a utility tray 52 for storing pencils or other related work items. The utility tray 52 is formed by a back wall or panel 54, a floor wall or panel 56, and a front wall or panel 58. In the preferred embodiment, the utility tray 52 is formed integrally with the support member 40 and is made from sheet metal and formed by conventional bending processes. In this embodiment, the support member 40 further includes flanges 60 and 62 which extend from both sides of the utility tray 52 and which function to connect the support member 40 to side walls 26 and 28 by conventional means such as rivets 37.

Referring to FIGS. 8–11, the stationary bracket 12 is shown generally comprising a mounting wall or panel 64 having a plurality of openings 66 so that the stationary bracket 12 may be mounted by conventional means such as screws to the bottom surface of a desk, table, or other work surface. The stationary bracket 12 further includes flanges 68 and 70 which are designed to slidably receive the flanges 42 and 44 of the main housing 14 so that the same may slide inward and outward of the stationary bracket 12. The flanges 68 and 70 each are formed with a side wall or panel 74 and a bottom wall or panel 72.

The stationary bracket 12 further includes locking mechanisms 19 which when engaged prevent the main housing 14 from sliding inward and/or outward from the stationary bracket 12. The locking mechanisms 19 each includes a mounting bracket 80 having side walls 82 and a mounting wall or floor 83 which is mounted by conventional means such as rivets 85 to the mounting wall 64. The locking mechanisms 19 further includes locking members 76 and 78, respectively, which are slidably disposed within the brackets 80. In the preferred embodiment, the locking members 76 and 78 are L-shaped bolts which are slidably disposed through openings (not shown) provided in the side walls 82. Locking member 76 is shown in the engaged position while locking member 78 is shown in the unengaged position. In the engaged position, each of the locking members 76 and 78 would engage with the openings 50 provided in the brackets 26 and 28 of the main housing 14 to prevent the main housing 14 from sliding inward and/or outward of the stationary bracket 12. In the unengaged position, each of the locking members 76 and 78 are clear of the openings 50 and as such the user may slide the main housing 14 inward and/or outward of the stationary bracket 12. The locking members 76 and 78 protrude through slots 84 provided in a front panel 86 of the stationary bracket 12 so that they may be easily accessible by the user of the device 10. The slots 84 are designed so that the locking members 76 and 78 may slide from the engaged position to the disengaged position.

Figures 12, 13, 14:
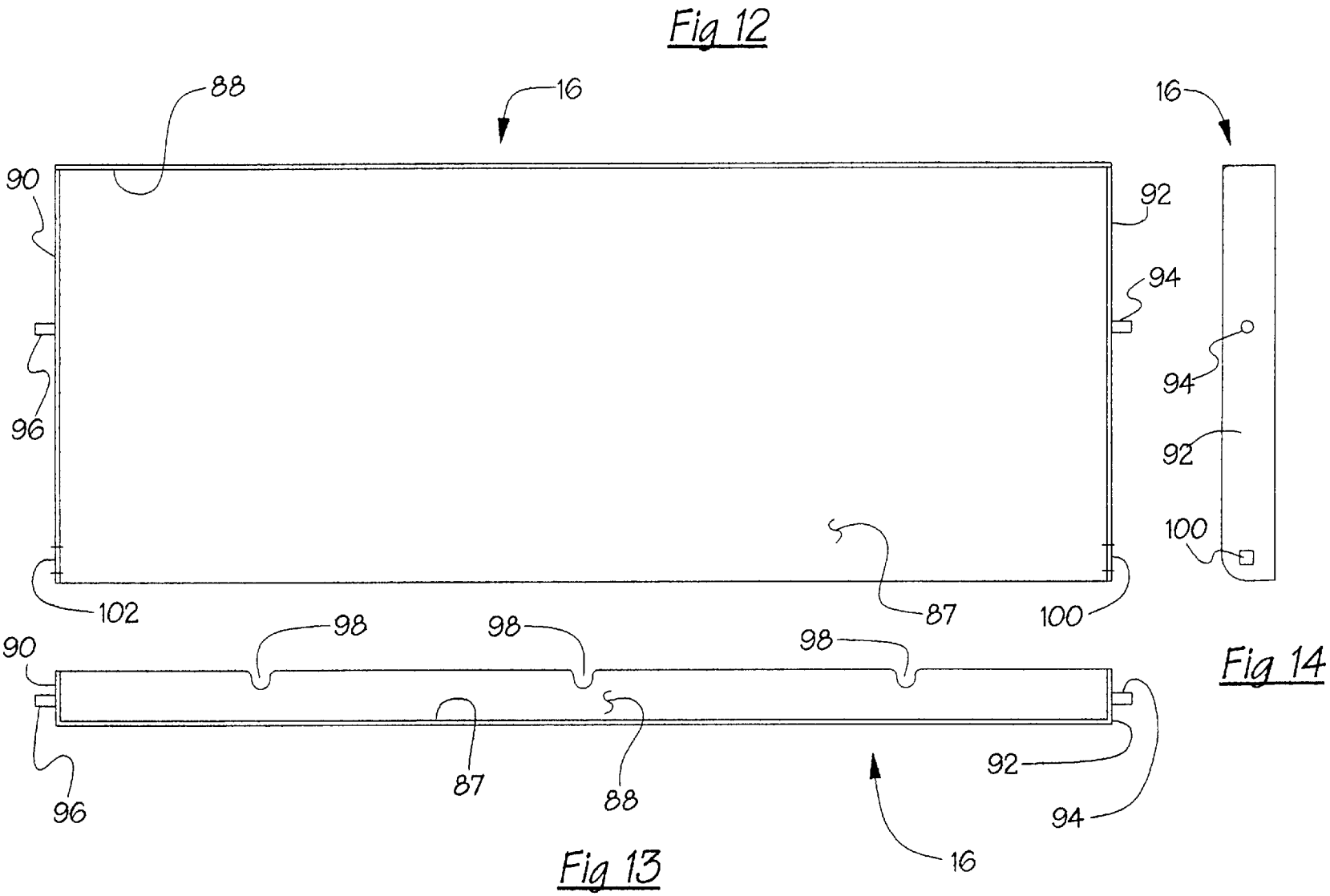
FIG. 12 is a top view of the keyboard support tray.
FIG. 13 is a front view of the keyboard support tray.
FIG. 14 is a side view of the keyboard support tray.

Referring to FIGS. 12–14, the keyboard support tray 16 is shown generally comprising a support surface 87, a rear side wall or panel 88, and side walls or panels 90 and 92. The keyboard support tray 16 further includes protrusions 94 and 96 which are adapted to be moveable within slots 36 of bracket members 32 and 34, respectively, of the main housing 14 and to further engage within one of the openings 38 of bracket members 32 and 34 to thereby establish a vertical position or elevation of the keyboard support tray 16. The protrusions 94 and 96 when engaged within one of the openings 38 act as a pivot point about which the keyboard support tray 16 may be rotatably adjusted to a variety of tilted positions. The keyboard support tray 16 further includes a plurality of cutouts or openings 98 disposed in rear wall 88 so that the cord of a keyboard may pass therethrough. The keyboard support tray 16 further includes openings 100 and 102 which are provided to engage with the engagement members 22 and 24. As will be described more fully herein, when the engagement members 22 and 24 are disengaged, the protrusions 94 and 96 of the keyboard support tray 16 may be moved within slots 36 of brackets 32 and 34 of the main housing 14 and engage within one of the openings 38 of the brackets 32 and 34. Once the engagement members 22 and 24 have been engaged, the protrusions 94 and 96 are locked within the selected vertical elevations defined by openings 38 and as such, the position of the keyboard support tray 16 relative to the main housing 14 is fixed. The keyboard support tray 16 is preferably made from sheet metal and formed by conventional bending processes.

Figure 16:
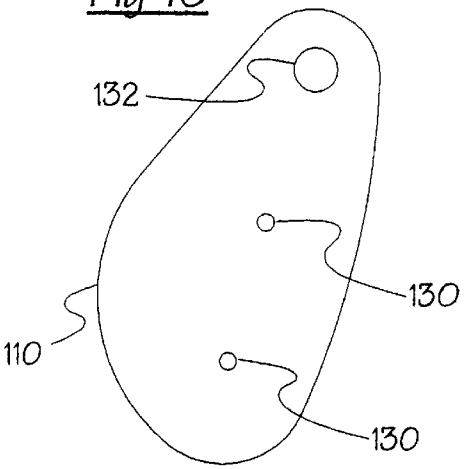
FIG. 16 is a side view of the palm rest.
Figure 17:
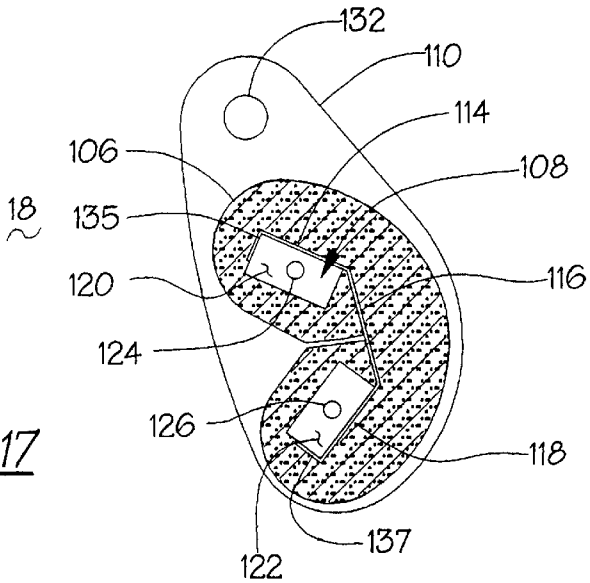
FIG. 17 is a cross-sectional view of the palm rest taken along line 17—17 of FIG. 15.
Figure 15:
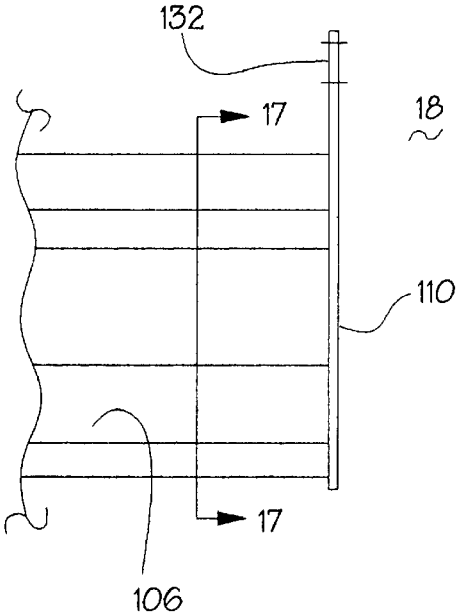
FIG. 15 is a top view of the palm rest.
Figure 15:
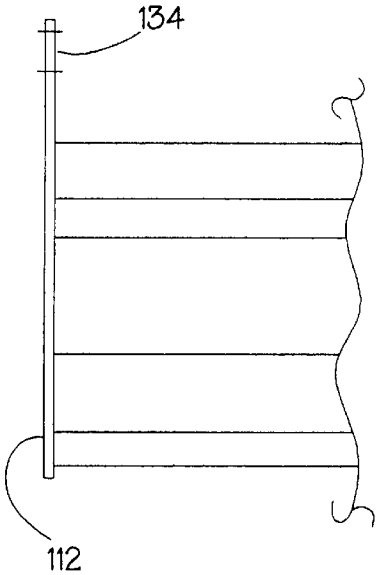

Referring to FIGS. 15–17, the palm rest 18 is shown generally including pliable material 106 disposed about a support arm 108. The palm rest 18 further includes side arms 110 and 112 which attach to each end of the support arm 108, respectively. In the preferred embodiment, the support arm 108 is generally formed of a single piece of sheet metal and is formed to have walls 114, 116, 118, 135 and 137. The pliable material 106 is preferably disposed around the outside of the walls 114, 116, 118, 135 and 137 and attached by an adhesive material to the inner portion of the wall 116. In the preferred embodiment, the pliable material 106 is made from a foam material. Alternatively, the pliable material 106 may be made from any other soft and comfortable material to act as a cushion for the user's palms and wrists. The support arm 108 further includes flanges 120 and 122 having openings 124 and 126 disposed on both sides of the support arm 108 which act as a mounting surface for attachment to the side arms 110 and 112 by conventional means such as rivets 130. The side arms 110 and 112 further include openings 132 and 134, respectively, which allow the palm rest 18 to be adjustably attached to the engagement members 22 and 24. As will be described more fully herein, when the engagement members 22 and 24 are disengaged, the palm rest 18 may be adjusted rotatably to any one of a variety of positions. Once the engagement members 22 and 24 have been engaged, the position of palm rest 18 relative to the keyboard support tray 16 and/or the main housing 14 is fixed.

Figure 18:
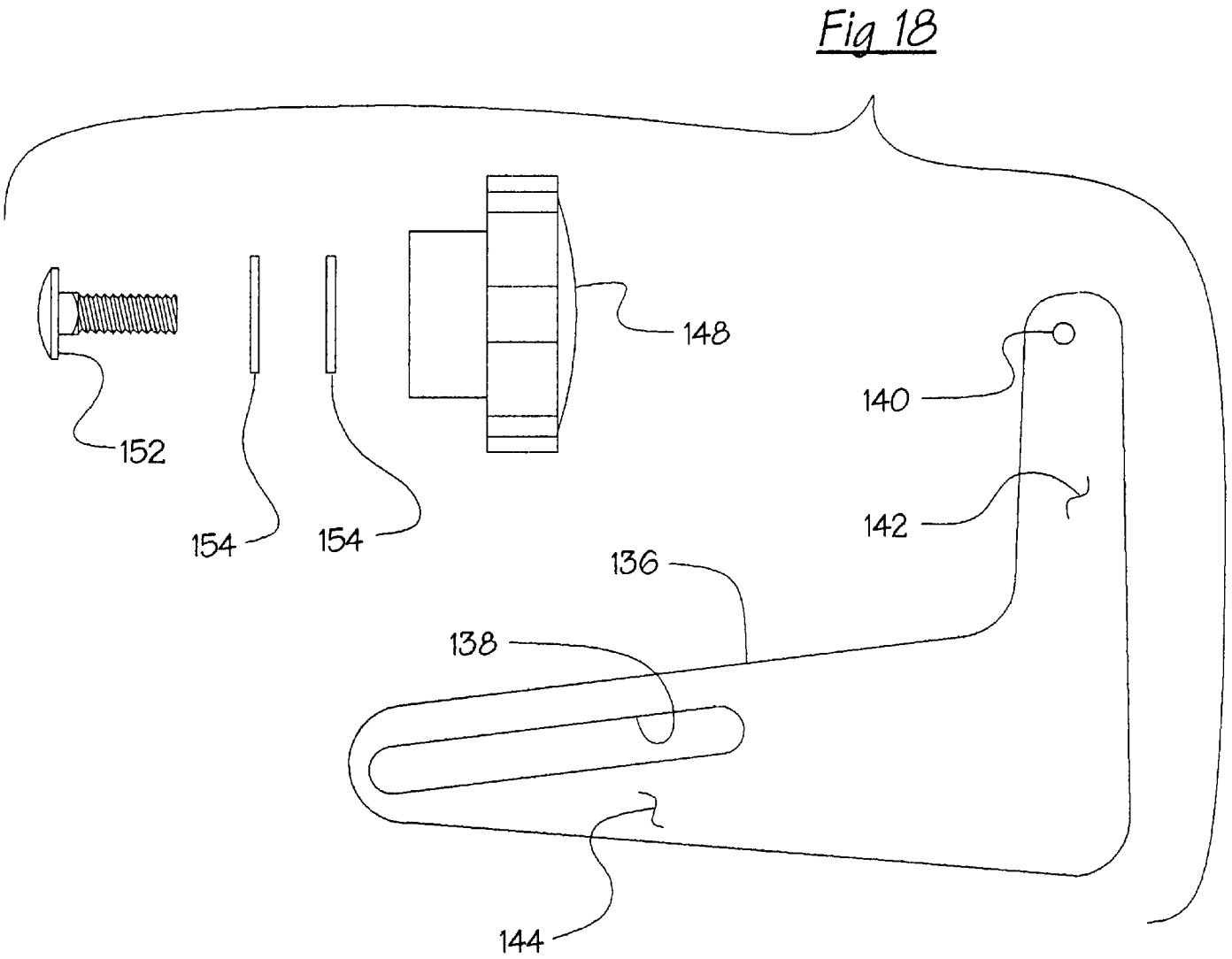
FIG. 18 is an view of the engagement member components.

Referring to FIG. 18, an exploded view of the engagement member 24 is shown. The structure and operation of the engagement member 22 is similar to that of engagement member 24 and as such a description of the structure and operation of the engagement member 22 will not be provided herein. The engagement member 24 generally includes a bracket member 136, a bolt 152 and a knob 148. The bracket member 136 includes a vertically extending portion 142 and a horizontally extending portion 144 having a slot 138. Disposed within the vertically extending portion 142 is an opening 140 which may be aligned with opening 53 of side bracket 32 of the main housing 14 and connected by conventional means such as a bolt whereby the bracket member 136 is rotatably connected to the main housing 14. As best shown by FIGS. 1–3, bolt 152 is adapted to pass through the side wall 92 of the keyboard support tray 16 via opening 100, the bracket member 136 via slot 138, and the palm rest 18 via opening 132. When the knob 148 is fully tightened or engaged upon the bolt 152, the engagement member 24 is in the "engaged position" and functions to prevent the keyboard support 16 and palm rest 18 from being moved. When the knob 148 is loosened from the bolt 152, the engagement member 24 is in the "disengaged position" whereby the keyboard support tray 16 and palm rest 18 may be adjusted to the desired position. The engagement member 24 may further include one or more washers 154 interposed between the bracket member 136, the palm rest 18, and the keyboard support tray 16 to more securely fix the position of the keyboard support tray 16 and the palm rest 18 when the engagement member 24 is placed in the engaged position.

Figure 21:
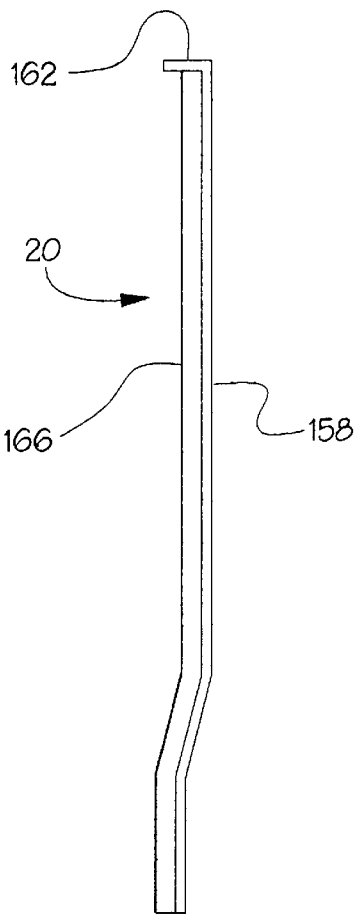
FIG. 21 is a side view of the mouse support tray.
Figure 19:
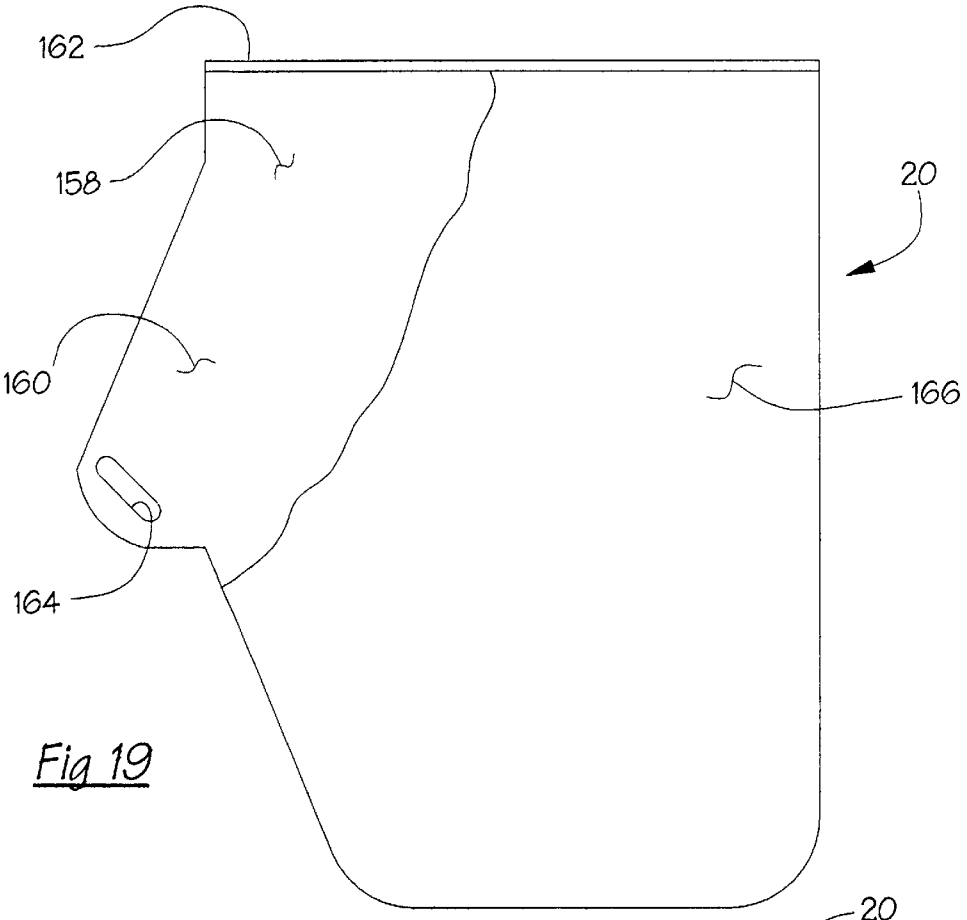
FIG. 19 is a top view of the mouse support tray.
Figure 20:
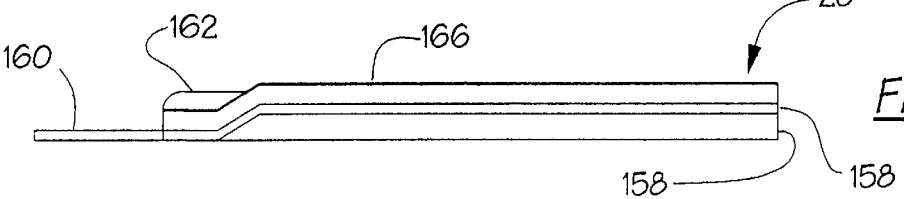
FIG. 20 is front view of the mouse support tray.

Referring to FIGS. 19–21, the mouse support tray 20 generally includes a support member 158 having a mounting portion 160 and a rear wall 162. Disposed over the support member 158 is a cushioned and/or pliable material 166 suitable for use with a computer mouse. The mounting portion 160 has a slot 164 which, as will be described hereinafter, provides a means of adjustably mounting the mouse support tray 20 to the main housing 14 and/or to a bracket 168 (to be described).

Figure 22:
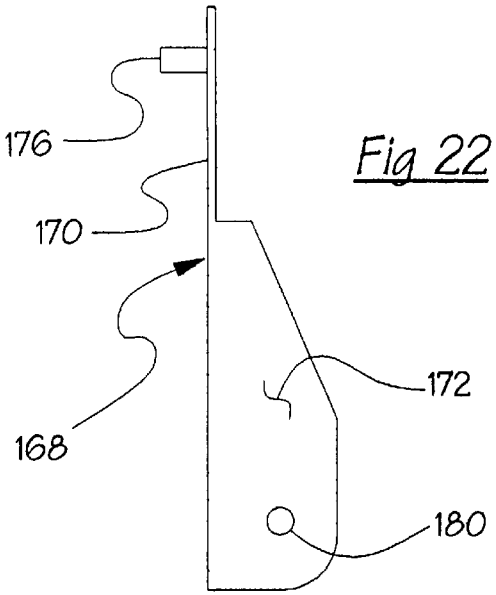
FIG. 22 is a top view of the mouse support tray mounting bracket.
Figure 23:
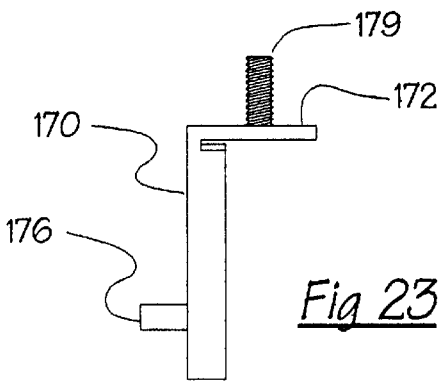
FIG. 23 is a front view of the mouse support tray mounting bracket.
Figure 24:
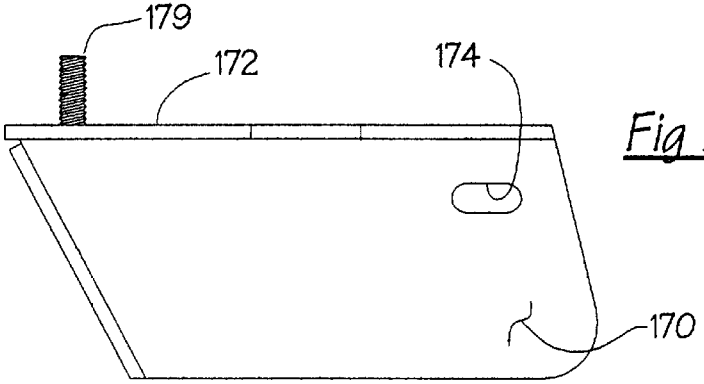
FIG. 24 is a side view of the mouse support tray mounting bracket.

Referring to FIGS. 22–24, the mouse support tray 20 may further include a mounting bracket 168 which is generally adapted to mount adjustably to the main housing 14 and to allow the mouse support tray 20 to be movably adjusted thereon. The mounting bracket 168 includes a side wall or mounting surface 170 having a slot or opening 174 and a protrusion 176. The slot 174 and protrusion 176 are adapted to be mounted adjustably to the main housing 14 by conventional means such as a bolt (not shown) and a knob 178 (FIGS. 1–3). The slot 174 allows the bolt (not shown) and the knob 178 when unengaged to be moved up or down within the slot 174. The protrusion 176 rides within the slot 30 to provide additional support. The mounting bracket 168 further includes a mounting member 179 which in the preferred embodiment is a threaded bolt securely positioned within an opening 180 provided on the mounting portion 172. The mouse tray support member 20 is adjustably positioned with respect to the mounting portion 172 by rotating the mouse tray support member 20 and then engaging a knob 182 (FIGS. 1–3) with the mounting member 179. Alternatively, the mounting bracket 168 could be eliminated or otherwise formed integrally with the main housing 14. As such, the mouse tray support 20 could be adjustably mounted directly to the main housing 14.

In operation, the stationary bracket 12 would first be attached to the bottom surface of a desk. Thereafter, the main housing 14 would be slidably engaged with the stationary bracket 12. Thereafter, the user would disengage engagement members 22 and 24 by loosening the knobs 146 and 148. Thereafter, the user would adjust the keyboard support tray 16 by simply placing his/her hands under the keyboard support tray 16 and selectively lifting the protrusions 94 and 96 of the keyboard support tray 16 into the openings 38 located on each of the side walls 26 and 28 of the main housing 14. Thereafter, the user can adjust the negative tilt angle of the keyboard support tray 16 by simply rotating the keyboard support tray upward and/or downward. To secure the position of the keyboard support tray 16, the engagement members 22 and 24 are engaged by simply tightening the knobs 146 and 148. Concurrently, the user may also adjust the position of the palm rest 18 by simply rotating the palm rest 18 at the same time that the tilt angle of the keyboard support tray 16 is being adjusted. When the engagement members 22 and 24 are engaged, both the keyboard support tray 16 and the palm rest 18 are fixed. Independently of the positioning of the keyboard support tray 16 and the palm rest 18, the vertical, horizontal, and angular position of the mouse support tray 20 may be adjusted.

Figure 25A:
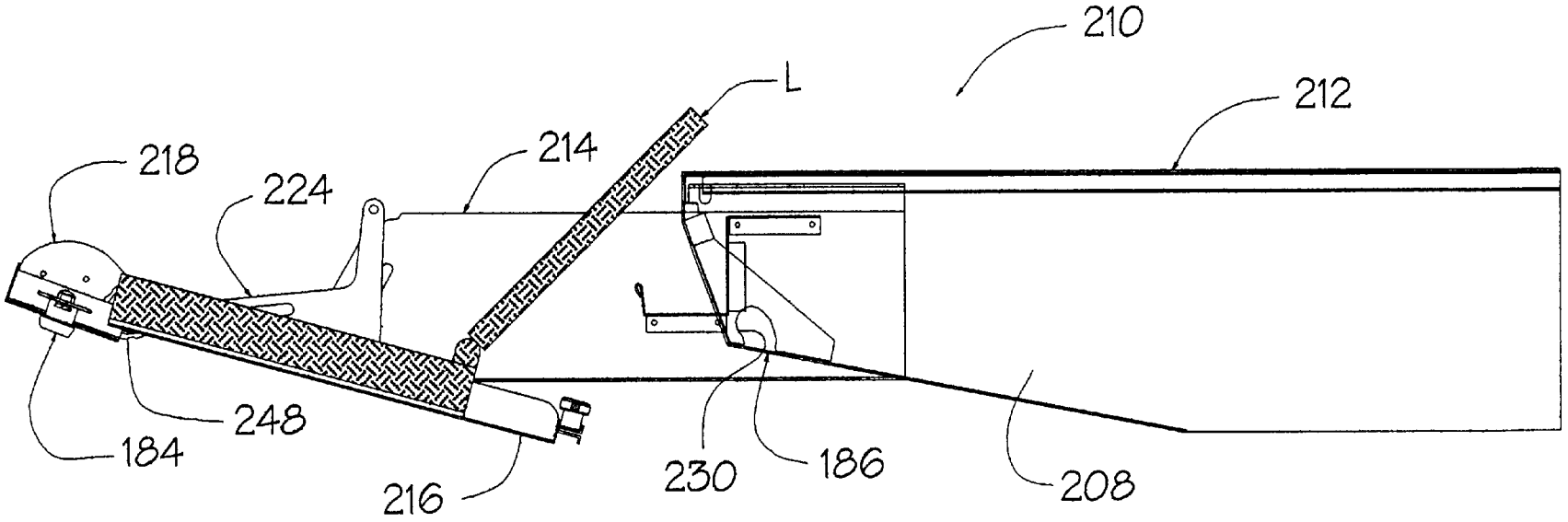
FIG. 25A is a sectional side view of an alternate embodiment of the device of the present invention in an operable position.

According to an alternative embodiment of the present invention depicted in sectional side view FIG. 25A, the device 210 includes a stationary bracket 212, main housing 214, keyboard support tray 216, and engagement members 224 as discussed hereinabove. A palm rest 218 is provided with an integral locking member 184 for securing the housing 214 at least in the stored position. A mouse support tray 20 may also be attached to the device 210, if desired. Adjustment of engagement members 224 and use of the device 210 is substantially similar to that of device 10. The tray 216 may be used to support a conventional computer keyboard or alternatively a laptop computer L, shown here with the display opened for use. The keyboard portion of the laptop computer is supported on the tray 216 at the desired negative angle and the palm rest oriented in an open position to support the operator's palms and wrists for ease of typing. As best seen in this view, a registration feature 186 is provided in each sidewall 208 of the stationary bracket 212 to align the palm rest 218 and locking member 184 and facilitate securing the device 210. In one embodiment, the registration feature 186 includes a contoured recess 230 to accept a shank of the knob 248 which lies along the pivot axis of the palm rest 218.

Figure 25B:
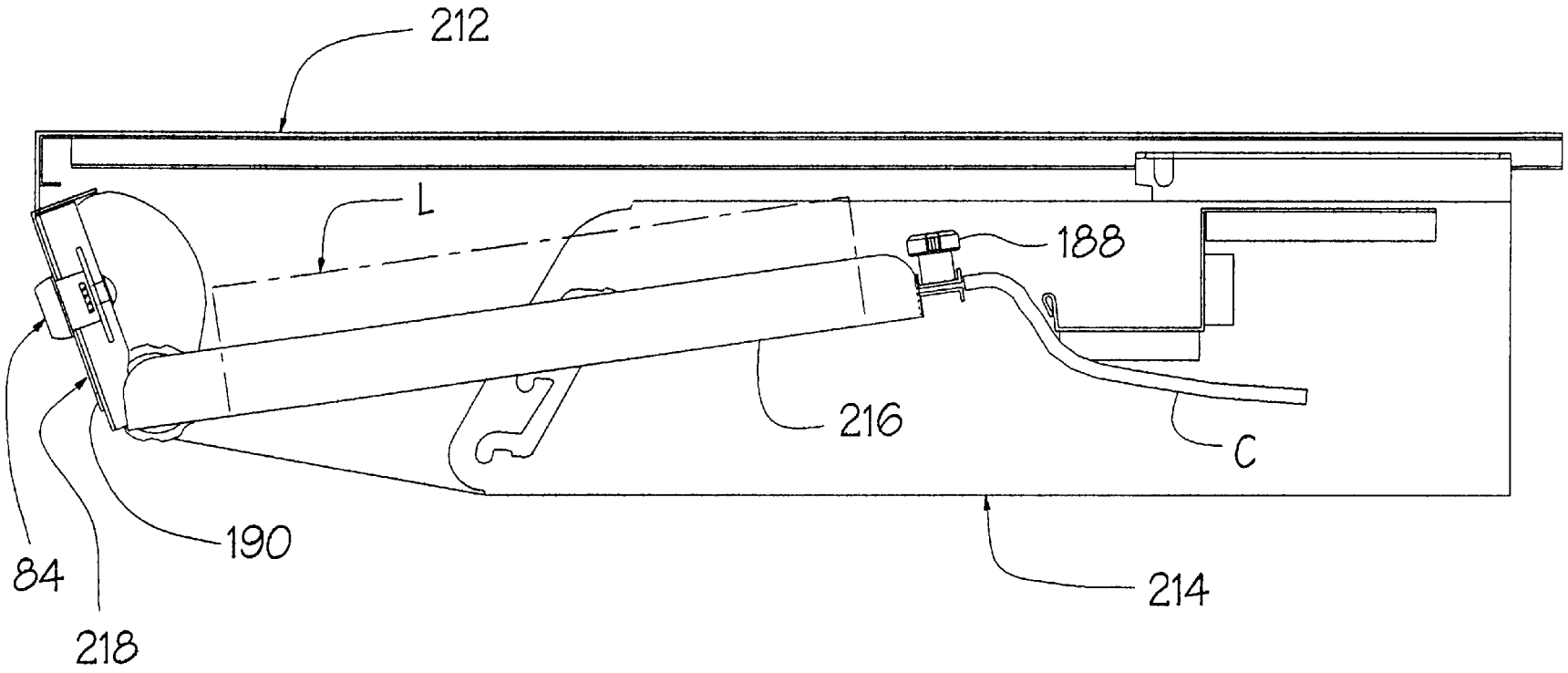
FIG. 25B is a sectional side view of the device depicted in FIG. 25A in a stored position.

As shown in FIG. 25B, the housing 214 has been moved to the stored position and the palm rest 218 pivoted to a closed position such that the laptop L or any other computer apparatus stored on the tray 216 is enclosed therein and inaccessible to unauthorized persons. To prevent the palm rest 218 from being pivoted to the open position and the housing 214 from being slid to the operable position, a portion of the locking member 184 has been actuated to create a mechanical interference with the stationary bracket 212, as will be discussed in greater detail hereinbelow. The tray 216 may optionally include a cord clamp 188 to restrain power or other cords C and facilitate connection of the laptop L, keyboard, or other computer apparatus thereto. When moving the housing between operable and stored positions, it may be necessary to change the angle or the elevation of the tray 216 so that the palm rest 218 and housing 214 are in the proper orientation for securing the locking member 184.

Figure 26A:
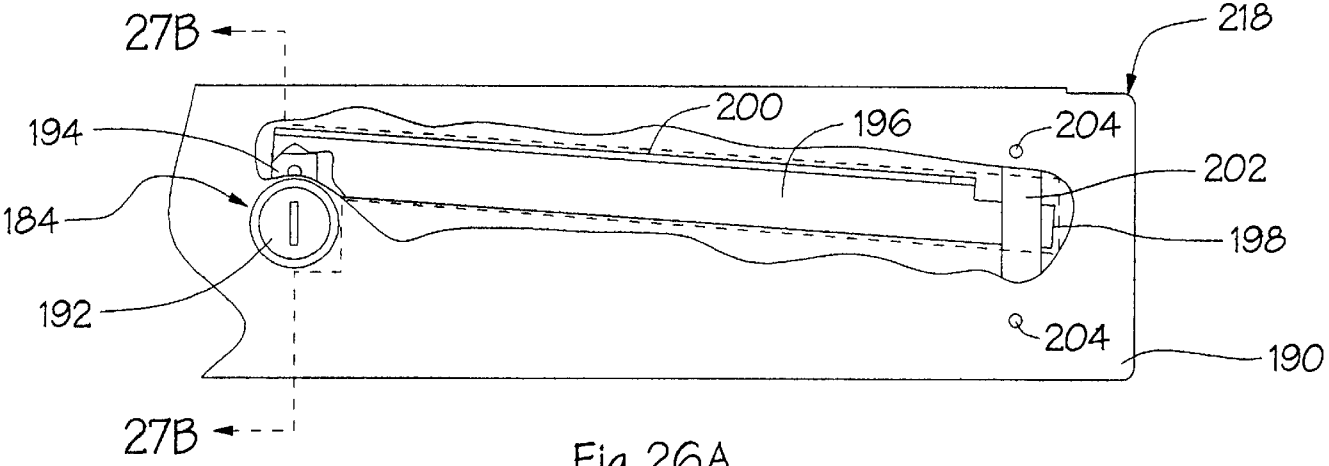
FIG. 26A is a partially broken away front view of a portion of the palm rest in a first condition.
Figure 26B:
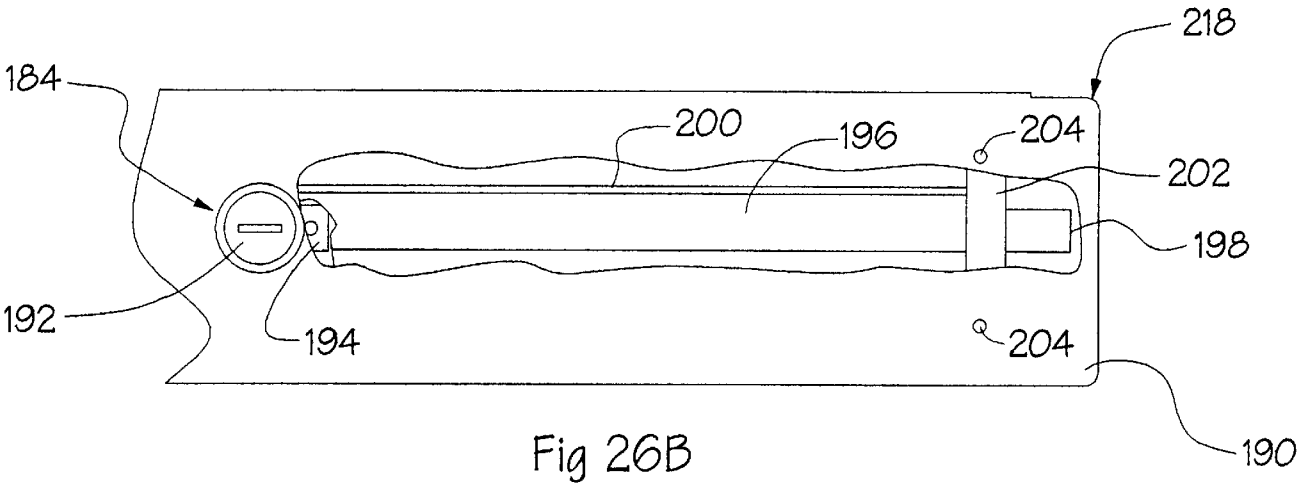
FIG. 26B is a partially broken away front view of a portion of the palm rest in a second condition.

Referring now to FIGS. 26A and 26B, a portion of the bottom or outer surface face plate 190 of the palm rest 218 is shown partially broken away to reveal the operation of the locking member 184. The locking member 184 includes a generally centrally disposed actuation member 192 such as a key lock, combination lock, or other mechanism which prevents unauthorized actuation. In one embodiment, a generally symmetrical mechanical linkage system cooperates with the actuation member 192 to secure the device 210. For simplicity, solely half of the linkage system is depicted and discussed; however, such a system may be employed, if desired. A short locking bar 194 attached to a spindle of the actuation member 192 is linked to two long locking bars 196 at respective proximal ends thereof. The long locking bars 196 extend generally along the major dimension of the palm rest 218 internally thereof. Respective distal ends 198 of the long bars 196 are maintained spaced from an internal surface of the face plate 190 by means of standoff flanges 200 formed therein. Accordingly, rotary motion of the actuation member 192 causes respective distal ends 198 of the long bars 196 to move between retracted and extended positions as shown respectively in FIGS. 26A and 26B.

Figure 27B:
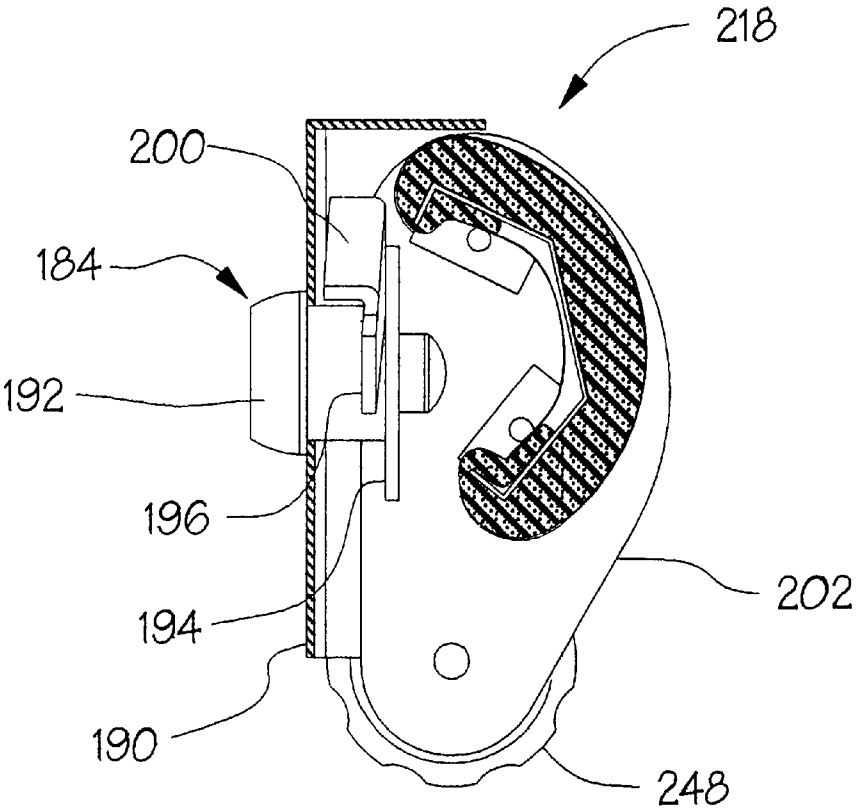
FIG. 27B is a cross-sectional view of the palm rest depicted in FIG. 26A taken along line 27B—27B.
Figure 27A:
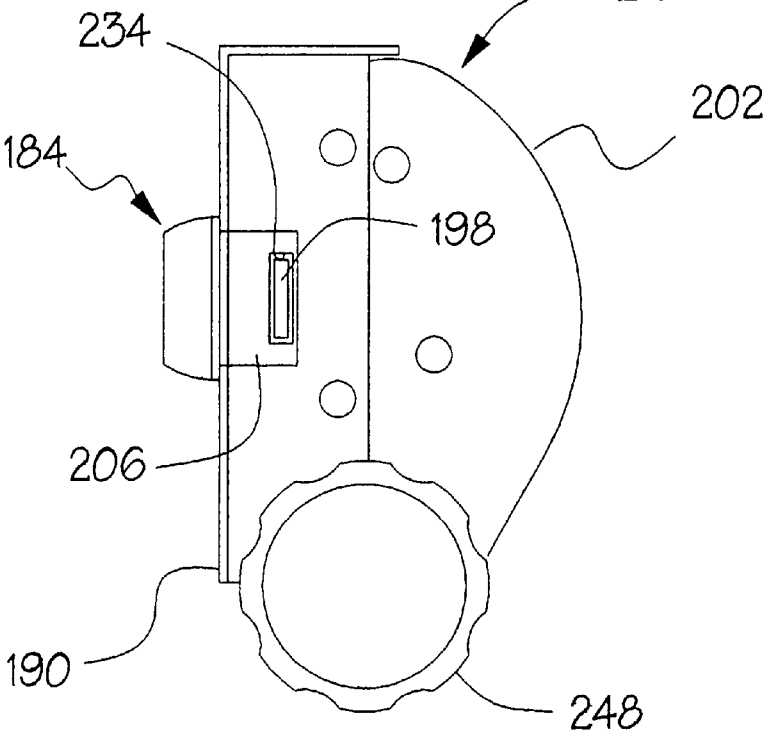
FIG. 27A is a side view of the palm rest.

As can be seen in FIG. 27A, which is a side view of the palm rest 218, the distal end 198 of each of the long bars 196 extends through a respective side arm 202 of the palm rest 218. The face plate 190 may be attached to the side arms 202 by means of rivets 204 passing through a flange thereof or a bracket attached thereto. Clearly other suitable fasteners or methods may be employed to produce an equivalent inseparable assembly.

As best seen in FIGS. 26A and 26B, the face plate 190 extends beyond the side arms 202 to prevent access to the bar distal ends 198 when the palm rest 218 is in the closed position. An anti-pry feature 206 such as one or more tabs or flanges attached to an inner surface of the face plate 190 and spaced from the side arms 202 may also be provided, the function of which will be more clear when discussed in conjunction with FIG. 28 hereinbelow.

The nesting of the locking member 184 with the other elements of the palm rest 218 is seen best in FIG. 27B, which is a cross-sectional view of the palm rest 218 depicted in FIG. 26A taken along line 27B—27B. The locking member 184 is depicted in the unlocked or unsecured position with the long locking bar 196 retracted. Solely one long locking bar 196 is depicted. The other long locking bar 196 would be linked to the short locking bar 194 generally below actuation member 192. The locking member 184, face plate 190, and associated structure is disposed remotely from the cushioned area of the palm rest 218 contacted by the palms or wrists of the user so as not to interfere with adjustment and use of the palm rest 218 as discussed hereinabove.

Figure 28:
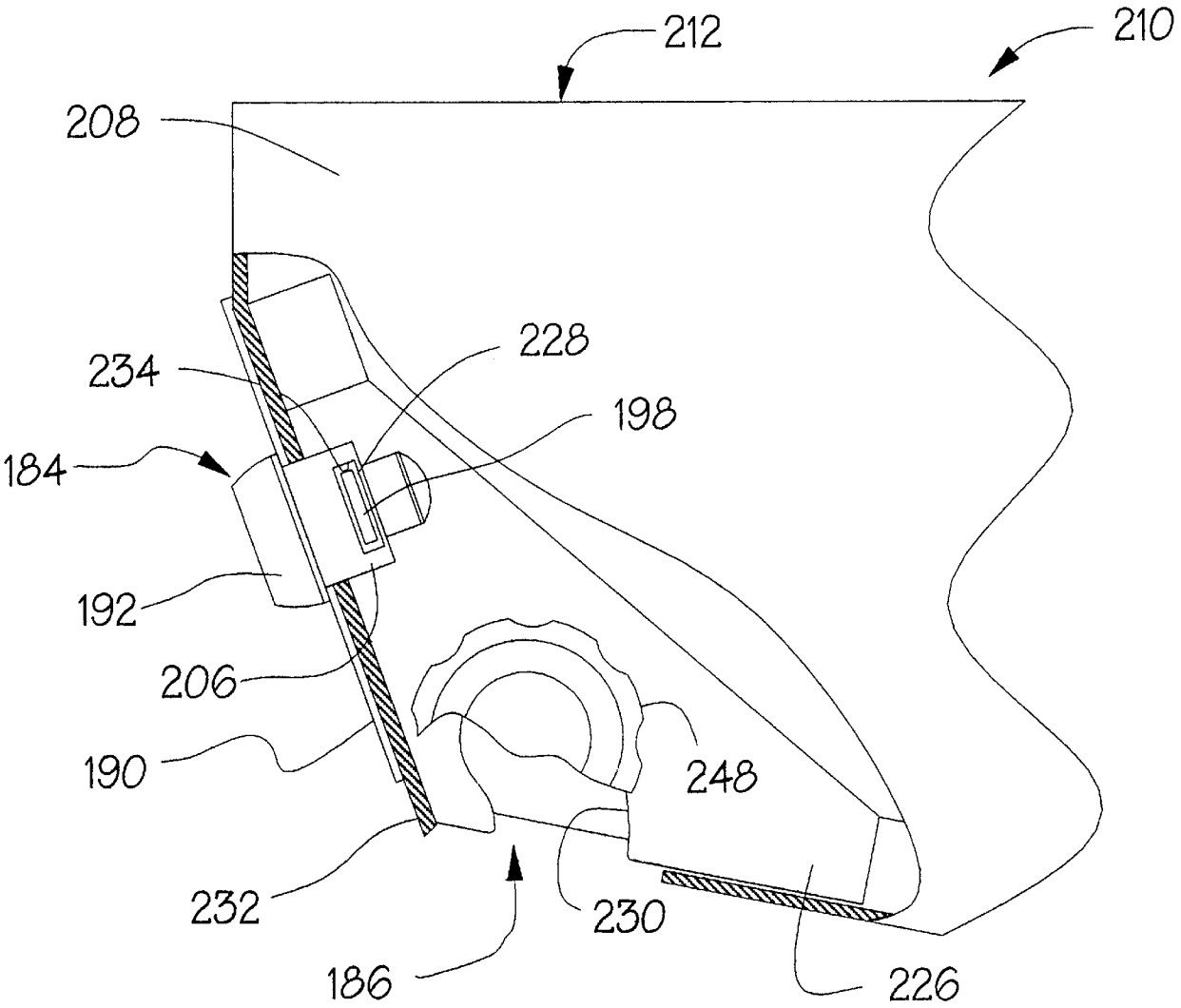
FIG. 28 is a partially broken away side view of a portion of the device in a stored position.

FIG. 28 is an enlarged, partially cut away side view of a front portion of the device 210 with the housing 214 in the stored position showing the registration feature 186 in detail. Each sidewall 208 of the stationary bracket 212 includes a locking plate 226 spaced inwardly therefrom. The locking plates 226 may be attached to the sidewalls 208 by riveted flanges or other suitable means. Each locking plate 226 includes an aperture 228 for receiving the distal end 198 of the respective locking bar 196 when in the extended position. Each locking plate 226 also includes an open recess 230 to receive the shank of the palm rest pivot knob 248 thereby creating the registration feature 186 which ensures alignment of the bar distal ends 198 with respective locking plate apertures 228.

In use, the device 210 may be quickly and readily secured by loosening both palm bar knobs 248 and sliding the housing 214 into the stored position in the stationary bracket 212. The palm bar pivot axis may then be lifted so that the knobs 248 pass into the space between the sidewalls 208 and adjacent locking plates 226 and the knob shanks register in the recesses 230. Thereafter, the palm rest 218 may be pivoted from the open position to the closed position at which point the face plate 190 abuts the front edges 232 of the sidewalls 208. The bar distal ends 198 are now aligned with the locking plate apertures 228. By rotating actuation member 192, the locking bars 196 are extended and the distal ends 198 thereof pass through the apertures 228, thereby securing the device 210 and preventing access to the keyboard support tray 216 and any computer apparatus stored thereon. Retraction of the distal ends 198 by rotation of the actuation member 192 in the opposite direction eliminates the mechanical interference and the housing 214 can be moved to an operable position for subsequent use. Depending on the size and configuration of the device 210 and the computer apparatus stored on the keyboard support tray 216, subsequent adjustment of the device 210 may need not be required.

To prevent forced entry by prying of the sidewalls 208 or locking plates 226 of the secured device 210 in an attempt to defeat the locking member 184 and release the palm rest 218 and housing 214 from the stationary bracket 212, an optional anti-pry feature 206 may be employed. By providing one or more tabs or flanges which pass through slots in the sidewall front edge 232 into the space between the sidewalls 208 and locking plates 226, the sidewalls 208 and locking plates 226 cannot be pried or spread apart with the palm rest 218 in the closed position. Accordingly, the security of the device 210 may be enhanced markedly. In a preferred embodiment, the anti-pry feature 206 may be centrally disposed on the face plate 190, as depicted, and may include an optional aperture 234 through which the locking bar distal end 198 projects when in the extended position. In this configuration, the combination of the face plate 190, locking bar distal end 198, and anti-pry feature flange 206 capture the locking plate 226. The anti-pry feature 206 may be provided on solely one side of the palm rest 218 or alternatively and advantageously on both sides of the palm rest 218 to capture both locking plates 226.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art. For example, the locking member 184 could be wholly or partially mounted on the stationary bracket 212, housing 214, or keyboard support tray 216. Alternatively or additionally, the locking member 184 need not be restricted to mechanical linkages but could include a flexible shaft with a rotatable and/or translatable core, or any of a variety of apparatus arranged to be movable between a first interference position with proximate structure and a second noninterference position with proximate structure.

We claim:

1. A securable device for a computer apparatus comprising:

a bracket;

a housing movably engageable with the bracket between a stored position and an operable position;

a palm rest mounted on the housing and pivotable about an axis relative to the bracket between a closed position and an open position; and a locking member for securing the housing at least in the stored position, wherein the locking member is disposed in the palm rest.

2. The invention according to claim 1 wherein the locking member comprises:

an actuation member; and a first member connected thereto having a portion thereof movable between:

an interference position with the bracket to prevent moving the housing from the stored position; and a noninterference position with the bracket to permit moving the housing from the stored position to the operable position.

3. The invention according to claim 1 wherein the housing comprises a support tray for receiving the computer apparatus.

4. The invention according to claim 3 wherein the support tray is pivotable about an axis relative to the bracket.

5. The invention according to claim 3 wherein the support tray is adjustable relative to an elevation of the bracket.

6. The invention according to claim 1 wherein the locking member comprises:

an actuation member; and a first member connected thereto having a distal end movable between a retracted position and an extended position.

7. The invention according to claim 6 wherein the bracket comprises at least one side wall forming an aperture therein to receive the member distal end when in the extended position.

8. The invention according to claim 7 wherein the side wall further forms a recess therein to receive a portion of the palm rest generally along the pivot axis to facilitate alignment of the member distal end with the aperture.

9. The invention according to claim 7 wherein the palm rest includes an anti-pry feature to prevent forced disengagement of the member distal end, when extended, from the aperture.

10. The invention according to claim 1 wherein:

the locking member comprises:

a lock;

a first bar having a distal end and a proximal end linked to the lock; and a second bar having a distal end and a proximal end linked to the lock wherein actuation of the lock displaces the first and second bar distal ends between retracted and extended positions; and the bracket comprises:

a first side wall forming an aperture therein to receive the first bar distal end when in the extended position; and a second side wall forming an aperture therein to receive the second bar distal end when in the extended position.

11. The invention according to claim 1 wherein the device further comprises a mouse support tray attached to the housing.

12. The invention according to claim 11 wherein the mouse support tray is adjustable from an outboard position to an inboard position.

13. The invention according to claim 11 wherein the mouse support tray is adjustable, relative to an elevation of the bracket.

14. The invention according to claim 11 wherein the mouse support tray is pivotable about an axis relative to the bracket.

* * * * *